US011808028B1

(12) United States Patent
Harbison

(10) Patent No.: US 11,808,028 B1
(45) Date of Patent: Nov. 7, 2023

(54) MODULAR BUILDING COMPONENT

(71) Applicant: Charles H. Harbison, Alexander City, AL (US)

(72) Inventor: Charles H. Harbison, Alexander City, AL (US)

( * ) Notice: Subject to any disclaimer, the term of this patent is extended or adjusted under 35 U.S.C. 154(b) by 0 days.

(21) Appl. No.: 18/095,764

(22) Filed: Jan. 11, 2023

(51) Int. Cl.
*E04B 1/343* (2006.01)
*E04B 1/32* (2006.01)

(52) U.S. Cl.
CPC ..... *E04B 1/34384* (2013.01); *E04B 1/32* (2013.01); *E04B 1/34331* (2013.01); *E04B 2001/3276* (2013.01); *E04B 2001/3288* (2013.01)

(58) Field of Classification Search
CPC .... E04B 1/32; E04B 1/34331; E04B 1/34384; E04B 2001/3276; E04B 2001/3288
USPC ..... 52/79.1
See application file for complete search history.

(56) References Cited

U.S. PATENT DOCUMENTS 3,368,316 A * 2/1968 Crowder ..... E04B 2/14 52/592.1
3,581,431 A * 6/1971 Trenovan ..... A63H 33/16 446/85
3,665,669 A * 5/1972 Huber ..... E04C 1/40 229/930
4,608,799 A * 9/1986 Hasegawa ..... E04B 2/18 52/578
4,784,172 A 11/1988 Yacoboni
5,125,867 A * 6/1992 Solomon ..... A63H 33/08 446/128
5,732,514 A 3/1998 Organ
6,282,849 B1 9/2001 Tuczek
9,896,835 B2 2/2018 Hauptman et al.
11,352,785 B2 * 6/2022 Simmons, Jr. ..... E04C 1/00
2021/0164256 A1 6/2021 Laue
2021/0396002 A1 * 12/2021 Largillier ..... E04B 1/34315

FOREIGN PATENT DOCUMENTS

| | | |
|---|---|---|
| CA | 2244135 | 2/2000 |
| WO | 2008134824 | 11/2008 |
| WO | 2010047570 | 4/2010 |
| WO | 2018128550 | 7/2018 |

* cited by examiner

*Primary Examiner* — Brian E Glessner
*Assistant Examiner* — James J Buckle, Jr.
(74) *Attorney, Agent, or Firm* — Taylor English Duma LLP

(57) ABSTRACT

An exemplary modular building component disclosed herein includes at least three side walls connected to each other to form a frame structure having an open exterior end and an open interior end, in various aspects. Each of the side walls includes a mating inner structural wall and an outer pivoting wall, in various aspects. The structural wall and the pivoting wall each include a top end and a bottom end, wherein the pivoting wall bottom end is adapted to pivotably engage the structural wall bottom end, in various aspects. A tautened fabric material covers the frame structure exterior end and is secured to each pivoting wall, in various aspects. The fabric is tautened over the frame structure exterior end as each pivoting wall top end is pivoted into abutment with its mating structural wall top end, in various aspects. Related methods are disclosed.

12 Claims, 6 Drawing Sheets

MODULAR BUILDING COMPONENT

FIELD OF THE INVENTION

This disclosure relates to a modular building component and related methods of manufacture and use.

BACKGROUND OF THE INVENTION

Modular building components are well known and are available in numerous designs and made from all types of materials depending on their desired uses. These components may be prefabricated at remote locations and shipped to a construction site for use in building structures of various types. The modular design promotes consistency in product quality and features. Innovations in modular building components frequently promote better quality building products that are easier to implement.

One type of product amenable to a modular design is a frame structure having sides formed from a rigid material (e.g., wood, plastic, metal, etc.) and one or more open ends wherein at least one open end is covered with a fabric material. For example, U.S. Pat. No. 9,896,835 to Hauptman et al. teaches a modular structure having a fabric covering to allow light and sound transmission therethrough and PCT Publication No. WO 2018/128550 to Halldorsson teaches a modular structure having a vapor barrier and/or wind barrier covering.

At times, it may be desirable to have a strong, durable fabric covering that is very taut so that it can resist external forces yet still allow light and/or sound transmission therethrough. Accordingly, there is a need for an improved modular building component as well as related methods of manufacture and use.

BRIEF SUMMARY OF THE INVENTION

These and other needs may be overcome by the apparatus and methods disclosed herein. Additional improvements and advantages may be recognized by those of ordinary skill in the art upon study of the present disclosure.

A modular building component and related methods, as disclosed herein, may include at least three side walls connected to each other to form a frame structure having an open exterior end and an open interior end, in various aspects. Each of the side walls may include an inner structural wall and an outer pivoting wall, in various aspects. The structural wall and the pivoting wall may each include a top end and a bottom end, wherein the pivoting wall bottom end may be adapted to pivotably engage the corresponding structural wall bottom end, in various aspects. A tautened fabric material may cover the frame structure exterior end and be secured to each pivoting wall, in various aspects. The fabric material may be tautened over the frame structure exterior end as each pivoting wall top end is pivoted into abutment with its corresponding structural wall top end, in various aspects.

This summary is presented to provide a basic understanding of some aspects of the apparatus and methods disclosed herein as a prelude to the detailed description that follows below. Accordingly, this summary is not intended to identify key elements of the apparatus or methods disclosed herein or to delineate the scope thereof.

Figure 1:
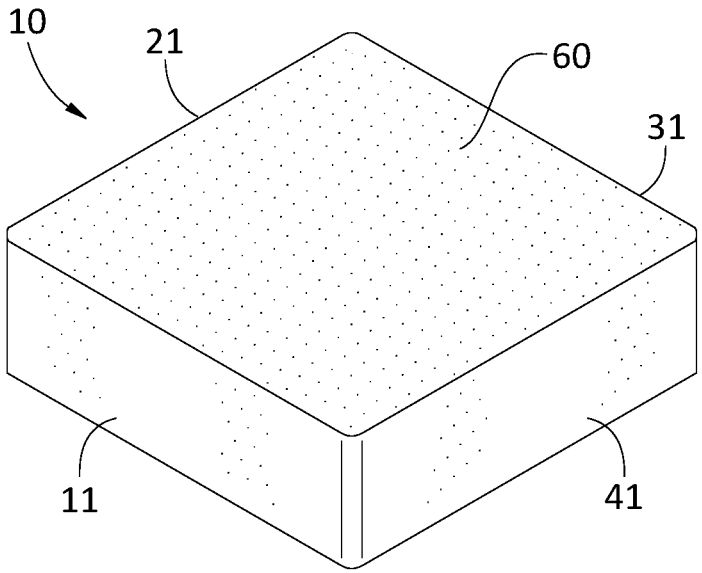
FIG. 1 illustrates by perspective view an exemplary implementation of a modular building component.

The Figures are exemplary only, and the implementations illustrated therein are selected to facilitate explanation. The number, position, relationship and dimensions of the elements shown in the Figures to form the various implementations described herein, as well as dimensions and dimensional proportions to conform to specific force, weight, strength, flow and similar requirements are explained herein or are understandable to a person of ordinary skill in the art upon study of this disclosure. Where used in the various Figures, the same numerals designate the same or similar elements. Furthermore, when the terms "top," "bottom," "right," "left," "forward," "rear," "first," "second," "inner," "outer," and similar terms are used, the terms should be understood in reference to the orientation of the implementations shown in the drawings and are utilized to facilitate description thereof. Use herein of relative terms such as generally, about, approximately, essentially, may be indicative of engineering, manufacturing, or scientific tolerances, or other such tolerances, as would be readily recognized by those of ordinary skill in the art upon study of this disclosure.

DETAILED DESCRIPTION OF THE INVENTION

A modular building component, as disclosed herein, includes at least three side walls connected to each other to form a frame structure, in various aspects. The frame structure can be any shape that can be juxtaposed and secured to other similar frame structures to form a larger structure, such as a wall, building, or the like. Thus, the frame structure may be triangular, rectangular (e.g., square), hexagonal, etc.

Figure 2:
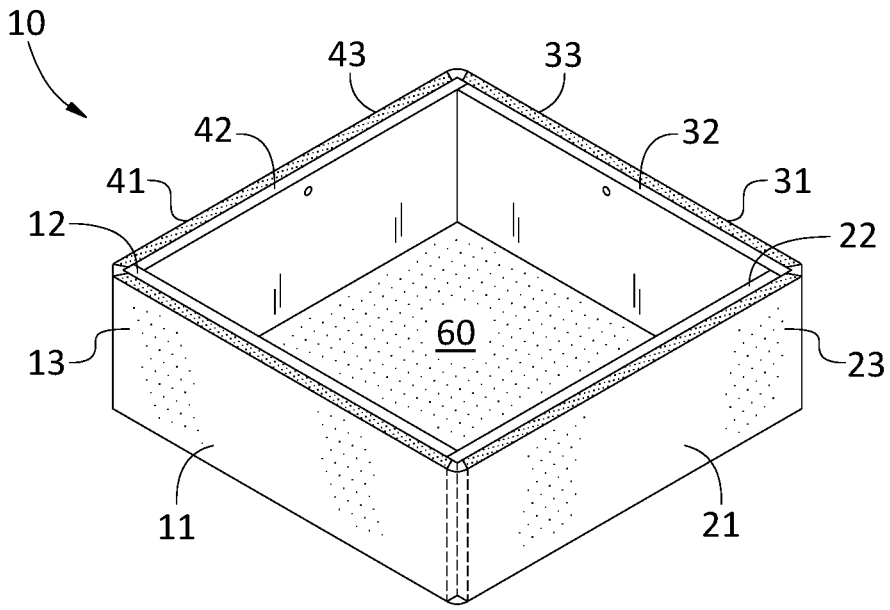
FIG. 2 illustrates by another perspective view the exemplary implementation of the modular building component of FIG. 1.

FIGS. 1-2 illustrate an assembled exemplary modular building component 10 and FIGS. 3-8 illustrate an exemplary method of assembling the exemplary modular building component 10 of FIGS. 1-2, in various aspects. The exemplary modular building component 10 shown in FIGS. 1-8 comprises a first side wall 11, a second side wall 21, a third side wall 31, and a fourth side wall 41. The first side wall 11 has an inner first structural wall 12 and an outer first pivoting wall 13. The first structural wall 12 has a top end 12A, a bottom end 12B, a first end 12C, and a second end 12D. The first pivoting wall 13 has a top end 13A and a bottom end 13B, wherein the first pivoting wall bottom end 13B is adapted to pivotably engage the first structural wall bottom end 12B. The first pivoting wall bottom end 13B may be hingedly attached to the first structural wall bottom end 12B.

The second side wall 21 has an inner second structural wall 22 and an outer second pivoting wall 23. The second structural wall 22 has a top end 22A, a bottom end 22B, a first end 22C, and a second end 22D. The second pivoting wall 23 has a top end 23A and a bottom end 23B, wherein the second pivoting wall bottom end 23B is adapted to pivotably engage the second structural wall bottom end 22B. The second pivoting wall bottom end 23B may be hingedly attached to the second structural wall bottom end 22B.

The third side wall 31 has an inner third structural wall 32 and an outer third pivoting wall 33. The third structural wall 32 has a top end 32A, a bottom end 32B, a first end 32C, and a second end 32D. The third pivoting wall 33 has a top end 33A and a bottom end 33B, wherein the third pivoting wall bottom end 33B is adapted to pivotably engage the third structural wall bottom end 32B. The third pivoting wall bottom end 33B may be hingedly attached to the third structural wall bottom end 32B.

The fourth side wall 41 has an inner fourth structural wall 42 and an outer fourth pivoting wall 43. The fourth structural wall 42 has a top end 42A, a bottom end 42B, a first end 42C, and a second end 42D. The fourth pivoting wall 43 has a top end 43A and a bottom end 43B, wherein the fourth pivoting wall bottom end 43B is adapted to pivotably engage the fourth structural wall bottom end 42B. The fourth pivoting wall bottom end 43B may be hingedly attached to the fourth structural wall bottom end 42B.

Figure 3:
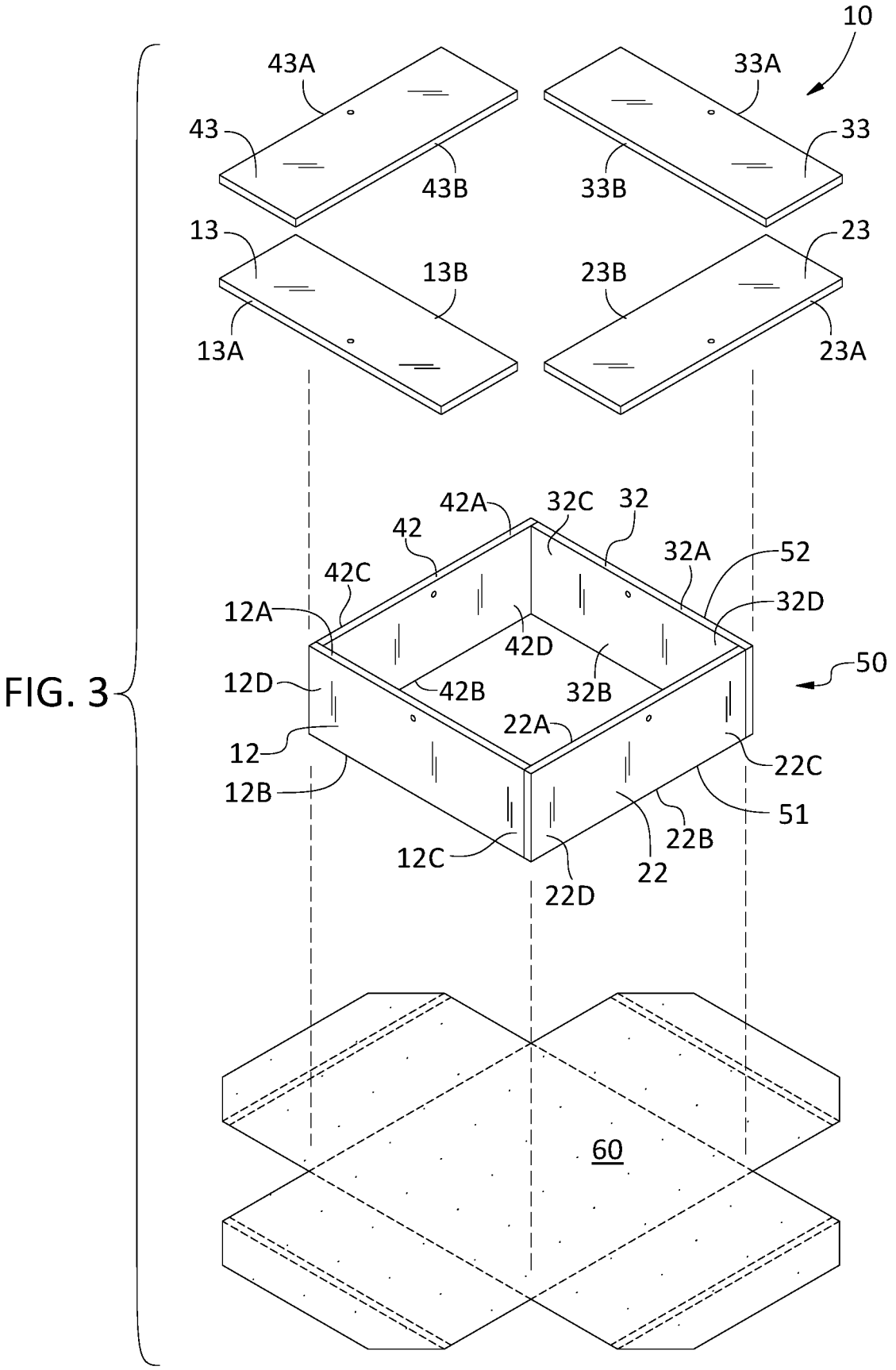
FIG. 3 illustrates by perspective view an exemplary method step in the assembly of the modular building component of FIG. 1.

In this implementation, the first structural wall first end 12C is secured to the second structural wall second end 22D, the second structural wall first end 22C is secured to the third structural wall second end 32D, the third structural wall first end 32C is secured to the fourth structural wall second end 42D, and the fourth structural wall first end 42C is secured to the first structural wall second end 12D, thereby forming a rectangular frame structure 50 having an exterior end 51 and an interior end 52, in various aspects (see FIG. 3). The structural wall ends may be secured together with fasteners (e.g., screws), glue, or other securing materials.

A fabric material 60 covers the frame structure exterior end 51 and is secured to each of the first pivoting wall 13, the second pivoting wall 23, the third pivoting wall 33, and the fourth pivoting wall 43, in various aspects. The fabric material 60 may be secured to the pivoting walls 13, 23, 33, 43 with fasteners (e.g., staples), glue, or other securing materials. The fabric material 60 may be made of a strong waterproof flexible fabric, such as polypropylene, polyester or nylon. The structural walls 12, 22, 32, 42 and pivoting walls 13, 23, 33, 43 may be made of wood, rigid plastic, or metal, or a combination thereof.

Figure 4:
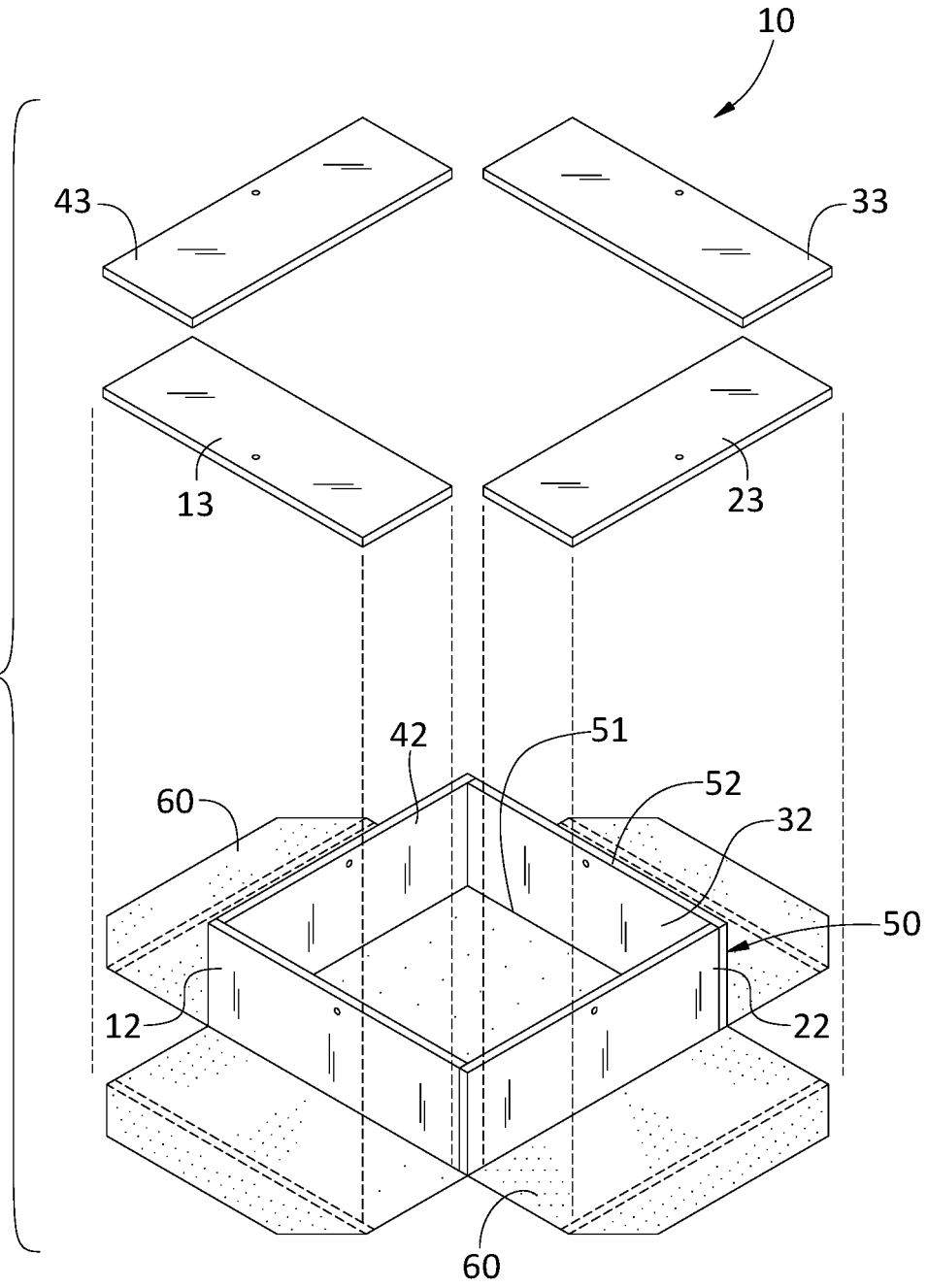
FIG. 4 illustrates by perspective view another exemplary method step in the assembly of the modular building component of FIG. 1.
Figure 5:
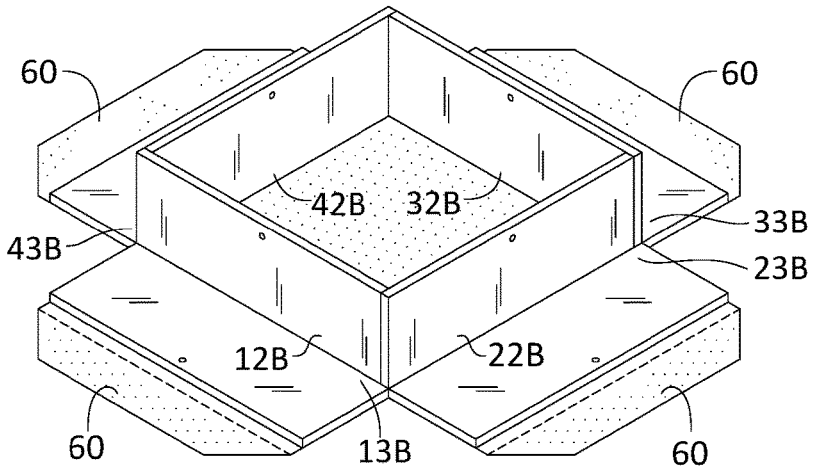
FIG. 5 illustrates by perspective view another exemplary method step in the assembly of the modular building component of FIG. 1.
Figure 6:
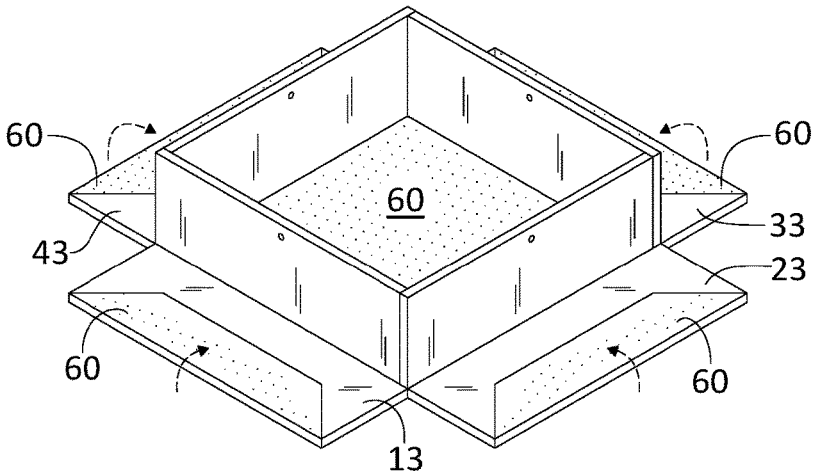
FIG. 6 illustrates by perspective view another exemplary method step in the assembly of the modular building component of FIG. 1.
Figure 7:
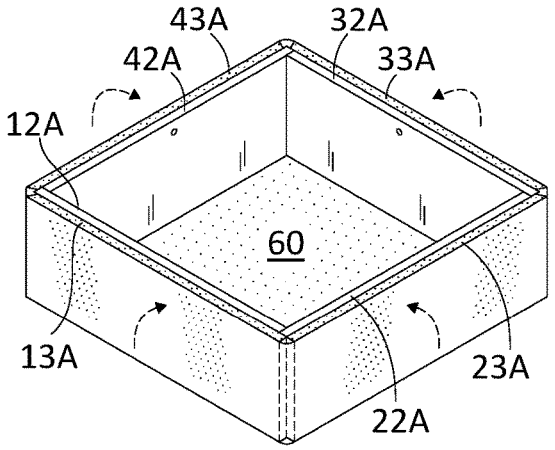
FIG. 7 illustrates by perspective view another exemplary method step in the assembly of the modular building component of FIG. 1.
Figure 8:
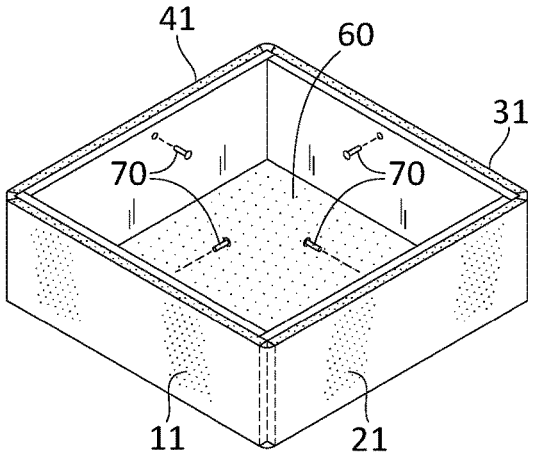
FIG. 8 illustrates by perspective view another exemplary method step in the assembly of the modular building component of FIG. 1.

An exemplary method of assembling the above exemplary modular building component 10 is shown in FIGS. 3-8. First, the structural walls 12, 22, 32, 42 are secured together to form the frame structure 50 (FIG. 3). Next, the open exterior end 51 of the frame structure 50 is covered by the fabric material 60 (FIG. 4). Next, the pivoting wall bottom ends 13B, 23B, 33B, 43B are secured to or juxtaposed against their mating structural wall bottom ends 12B, 22B, 32B, 42B, respectively (FIG. 5). Next, the fabric material 60 is secured to the pivoting walls 13, 23, 33, 43, preferably on inner surfaces thereof (FIG. 6). Next, each pivoting wall top end 13A, 23A, 33A, 43A is pivoted into abutment with its mating structural wall top end 12A, 22A, 32A, 42A, respectively (FIG. 7), wherein the fabric material 60 is stretched and thereby tautened over the frame structure exterior end 51 as each pivoting wall top end 13A, 23A, 33A, 43A is pivoted into abutment with its mating structural wall top end 12A, 22A, 32A, 42A, respectively. The foregoing pivoting steps use leverage to tauten the fabric over the frame structure exterior end 51. Next, each pivoting wall top end 13A, 23A, 33A, 43A is secured to its mating structural wall top end 12A, 22A, 32A, 42A, respectively, with a plurality of fasteners 70 (e.g., screws, nails, etc.) (FIG. 8), thereby forming the exemplary modular building component 10 shown in FIGS. 1-2, in various aspects.

If desired, the space within the modular component 10 can be filled with a material, such as insulation, and then a back cover can be applied over the interior end 52 to maintain the material within the space, in various aspects.

Figure 9:
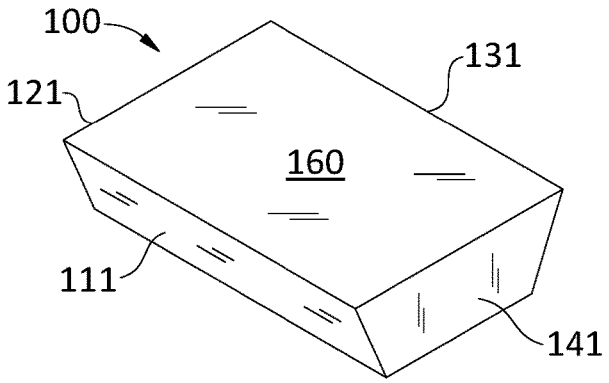
FIG. 9 illustrates by perspective view another exemplary implementation of a modular building component.
Figure 10:
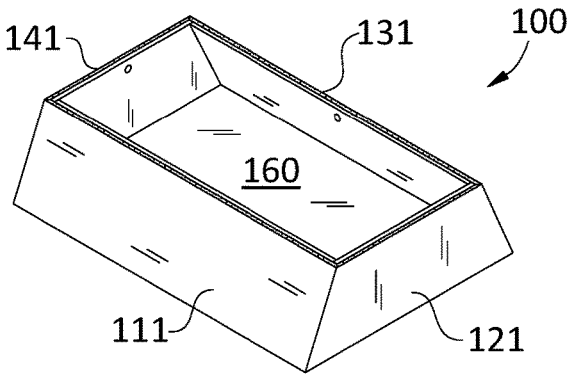
FIG. 10 illustrates by another perspective view the exemplary implementation of the modular building component of FIG. 9.

FIGS. 9-10 illustrate another exemplary implementation of a modular building component 100. In this implementation, the first side wall 111 and third side wall 131 are rectangular and the second side wall 121 and fourth side wall 141 are trapezoidal, thus forming a modular building component 100, including a fabric covering 160, that can be secured to other similar modular building components to form a curved structure, such as that shown in FIG. 11, in various aspects.

Figure 11:
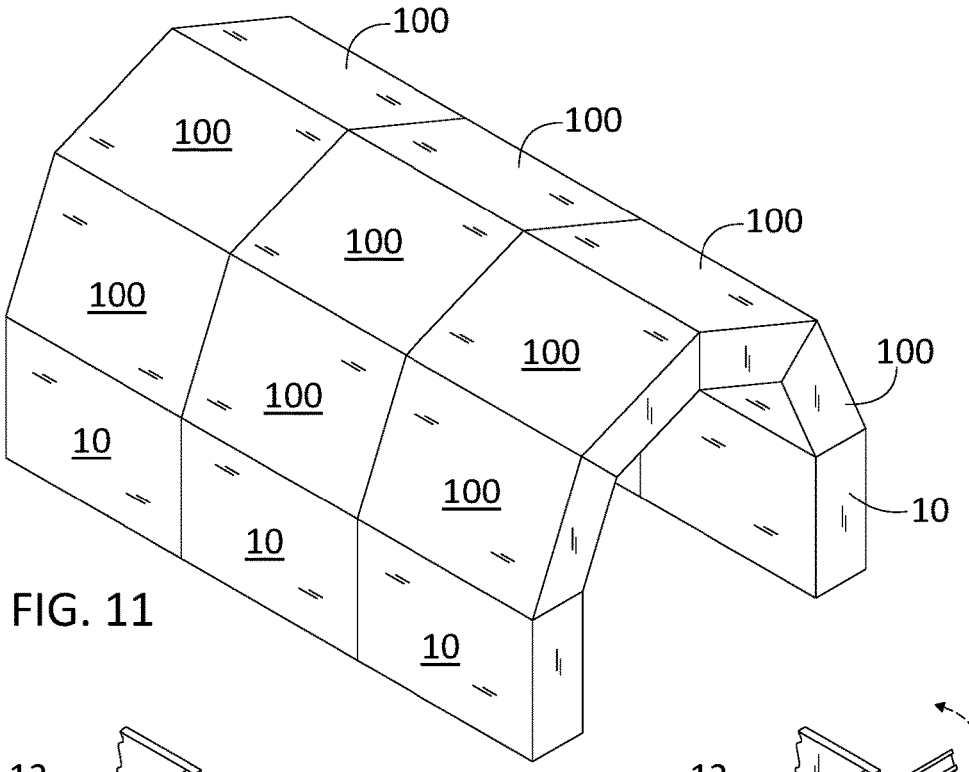
FIG. 11 illustrates by perspective view a building structure formed from the exemplary implementations of the modular building components of FIGS. 1-2 and FIGS. 9-10.

FIG. 11 illustrates a building structure in the shape of a tunnel structure 180 (e.g., carport) formed from a combination of the exemplary implementations of the modular building components 10, 100 of FIGS. 1-2 and FIGS. 9-10, respectively. The modular building components 10, 100 can be attached to each other using bolts, screws, nails, or the like. The joints between the modular building components 10, 100 can be sealed with a sealant (e.g., silicone) if desired.

Figure 12:
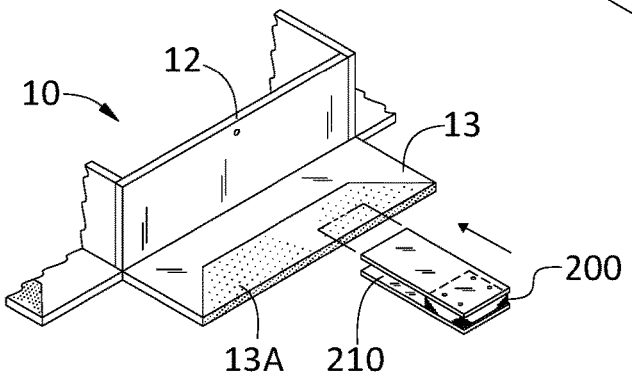
FIG. 12 illustrates by schematic view an exemplary method step in the assembly of an exemplary modular building component.
Figure 13:
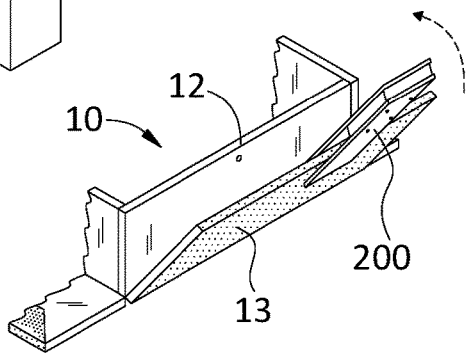
FIG. 13 illustrates by schematic view another exemplary method step in the assembly of an exemplary modular building component.

FIGS. 12-13 illustrate exemplary method steps in the assembly of an exemplary modular building component, such as modular building component 10, wherein a tool 200 having a slot 210 for receiving a pivoting wall top end therein, such as pivoting wall top end 13A, can be used to pivot a pivoting wall, such as pivoting wall 13, into engagement with the mating structural wall, such as structural wall 12, in various aspects. As the pivoting walls of a modular building component are pivoted into engagement with the structural walls, the fabric material is increasingly tautened and, consequently, it may become difficult to pivot one or more pivoting walls into abutment with their respective mating structural walls due to increased tension on the fabric material. The tool 200 provides leverage to overcome resistance from the increased tension.

Figure 14:
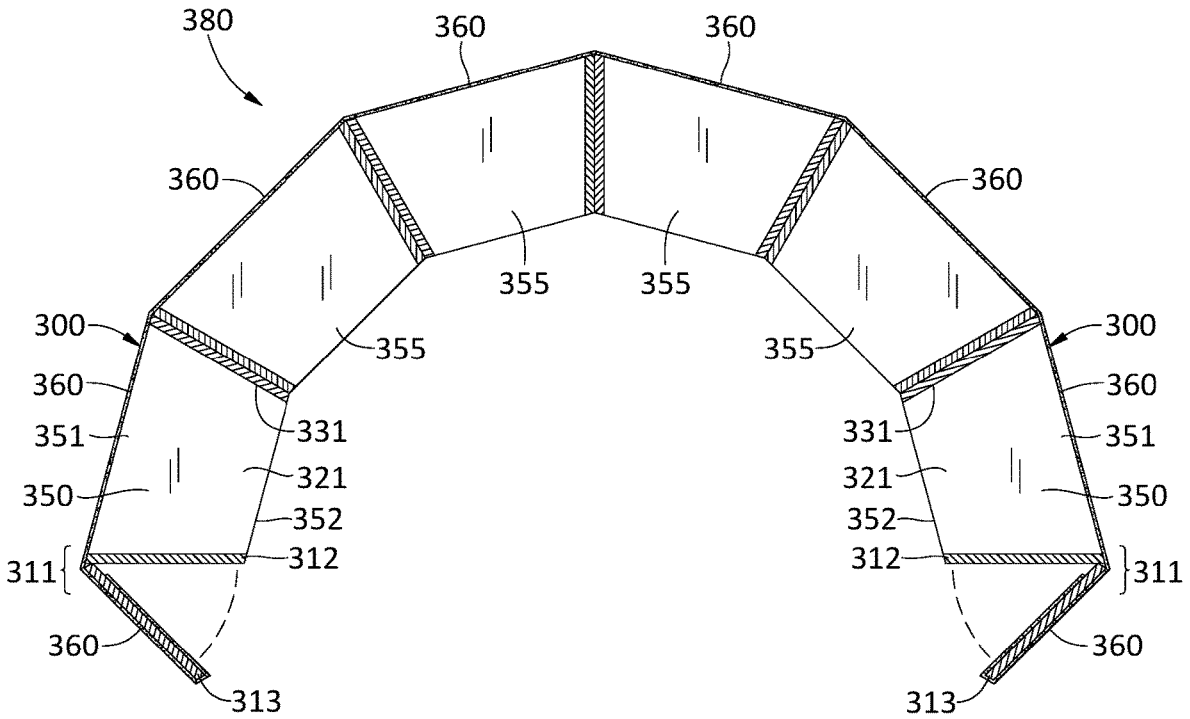
FIG. 14 illustrates by schematic sectional view an exemplary method step in the assembly of a building structure formed from an exemplary implementation of the modular building component.
Figure 15:
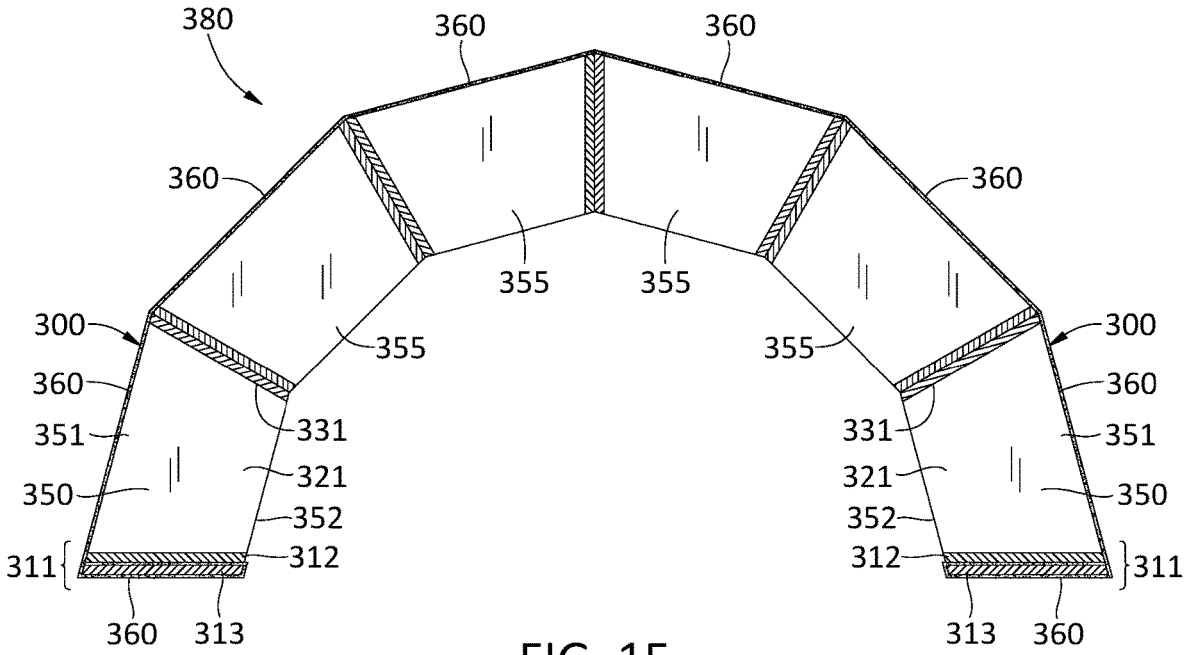
FIG. 15 illustrates by schematic sectional view another exemplary method step in the assembly of the building structure of FIG. 14.

FIGS. 14-15 illustrate another exemplary implementation of a modular building component 300 and exemplary method steps in the assembly of a building structure in the shape of a tunnel structure 380 (e.g., Quonset hut). In this implementation, modular building component 300 has four side walls, where first side wall 311, second side wall 321, and third side wall 331 are shown. First side wall 311 includes structural wall 312 and pivoting wall 313, whereas the remaining side walls may include only the structural wall component, in this implementation. The side walls form rectangular frame structure 350 having an exterior end 351 and an interior end 352, in various aspects. In this implementation, the modular building components 300 are on opposing ends of the structure 380, and one or more simple frame members 355, not having pivoting walls, are secured therebetween to form the tunnel structure 380. A continuous fabric material 360 covers the exterior of the tunnel structure 380, including the frame structure exterior ends 351, and is secured to each of the pivoting walls 313, in various aspects. The pivoting walls 313 are pivoted into abutment with their mating structural walls 312, respectively, wherein the fabric material 360 is stretched and thereby tautened over the exterior of the tunnel structure 380, including the frame structure exterior ends 351, as the pivoting walls 313 are pivoted into abutment with their mating structural walls 312, respectively, and secured thereto, in various aspects. The foregoing pivoting step(s) uses leverage to tauten the fabric over the tunnel structure 380, including the frame structure exterior ends 351.

The foregoing discussion along with the Figures discloses and describes various exemplary implementations. These implementations are not meant to limit the scope of coverage, but, instead, to assist in understanding the context of the language used in this specification and in the claims. The Abstract is presented to meet requirements of 37 C.F.R. § 1.72(b) only. Accordingly, the Abstract is not intended to identify key elements of the apparatus and methods disclosed herein or to delineate the scope thereof. Upon study of this disclosure and the exemplary implementations herein, one of ordinary skill in the art may readily recognize that various changes, modifications and variations can be made thereto without departing from the spirit and scope of the inventions as described herein and as defined in the following claims.

The invention claimed is:

1. A modular building component, comprising:

a) a first side wall having an inner first structural wall and an outer first pivoting wall, the first structural wall having a first end, a second end, a top end, and a bottom end, the first pivoting wall having a top end and a bottom end, wherein the first pivoting wall bottom end is adapted to pivotably engage the first structural wall bottom end;

b) a second side wall having an inner second structural wall and an outer second pivoting wall, the second structural wall having a first end, a second end, a top end, and a bottom end, the second pivoting wall having a top end and a bottom end, wherein the second pivoting wall bottom end is adapted to pivotably engage the second structural wall bottom end;

c) a third side wall having an inner third structural wall and an outer third pivoting wall, the third structural wall having a first end, a second end, a top end, and a bottom end, the third pivoting wall having a top end and a bottom end, wherein the third pivoting wall bottom end is adapted to pivotably engage the third structural wall bottom end;

d) a fourth side wall having an inner fourth structural wall and an outer fourth pivoting wall, the fourth structural wall having a first end, a second end, a top end, and a bottom end, the fourth pivoting wall having a top end and a bottom end, wherein the fourth pivoting wall bottom end is adapted to pivotably engage the fourth structural wall bottom end;

e) wherein the first structural wall first end is secured to the second structural wall second end, the second structural wall first end is secured to the third structural wall second end, the third structural wall first end is secured to the fourth structural wall second end, and the first structural wall second end is secured to the fourth structural wall first end, thereby forming a rectangular frame structure having an exterior end and an interior end;

f) a fabric material covering the exterior end and secured to each of the first pivoting wall, the second pivoting wall, the third pivoting wall, and the fourth pivoting wall; and g) wherein the fabric material is tautened over the exterior end as the first pivoting wall top end is pivoted into abutment with the first structural wall top end, the second pivoting wall top end is pivoted into abutment with the second structural wall top end, the third pivoting wall top end is pivoted into abutment with the third structural wall top end, and the fourth pivoting wall top end is pivoted into abutment with the fourth structural wall top end.

2. A modular building component according to claim 1, wherein the first structural wall, the second structural wall, the third structural wall, and the fourth structural wall are made of a material selected from the group consisting of wood, rigid plastic, and metal.

3. A modular building component according to claim 1, wherein the first pivoting wall, the second pivoting wall, the third pivoting wall, and the fourth pivoting wall are made of a material selected from the group consisting of wood, rigid plastic, and metal.

4. A modular building component according to claim 1, wherein the fabric material is made of a material selected from the group consisting of polypropylene, polyester and nylon.

5. A building structure, comprising:

a) a first modular building component having at least four side walls connected to each other to form a first frame structure having an open exterior end and an open interior end, wherein each of the at least four side walls of the first modular building component has a structural wall having a top end and a bottom end, wherein at least one of the at least four side walls of the first modular building component has a mating first pivoting wall having a top end and a bottom end, wherein the first pivoting wall bottom end is adapted to pivotably engage the mating structural wall bottom end;

b) a second modular building component having at least four side walls connected to each other to form a second frame structure having an open exterior end and an open interior end, wherein each of the at least four side walls of the second modular building component has a structural wall having a top end and a bottom end, wherein at least one of the at least four side walls of the second modular building component has a mating second pivoting wall having a top end and a bottom end, wherein the second pivoting wall bottom end is adapted to pivotably engage the mating structural wall bottom end; and c) a continuous fabric material covering the exterior end of both the first frame structure and the second frame structure, wherein the fabric material is secured to both the first pivoting wall and the second pivoting wall;

d) wherein the fabric material is tautened over the exterior end of both the first frame structure and the second frame structure as each pivoting wall top end is pivoted into abutment with its mating structural wall top end.

6. A building structure according to claim 5, wherein the first modular building component is secured directly to the second modular building component.

7. A building structure according to claim 5, wherein at least one frame member is secured between the first modular building component and the second modular building component.

8. A building structure according to claim 5, wherein the fabric material is made of a material selected from the group consisting of polypropylene, polyester and nylon.

9. A method of forming a building structure, comprising the steps of:

a) providing a first modular building component having at least four side walls connected to each other to form a first frame structure having an open exterior end and an open interior end, wherein each of the at least four side walls of the first modular building component has a structural wall having a top end and a bottom end, wherein at least one of the at least four side walls of the first modular building component has a mating first pivoting wall having a top end and a bottom end, wherein the first pivoting wall bottom end is adapted to pivotably engage the mating structural wall bottom end;

b) providing a second modular building component having at least four side walls connected to each other to form a second frame structure having an open exterior end and an open interior end, wherein each of the at least four side walls of the second modular building component has a structural wall having a top end and a bottom end, wherein at least one of the at least four side walls of the second modular building component has a mating second pivoting wall having a top end and a bottom end, wherein the second pivoting wall bottom end is adapted to pivotably engage the mating structural wall bottom end;

c) covering the first frame structure exterior end and the second frame structure exterior end with a continuous fabric material;

d) securing the fabric material to both the first pivoting wall and the second pivoting wall; and e) pivoting each pivoting wall top end into abutment with its mating structural wall top end and securing each pivoting wall top end to its mating structural wall top end;

f) wherein the fabric is tautened over the first frame structure exterior end and the second frame structure exterior end as each pivoting wall top end is pivoted into abutment with its mating structural wall top end.

10. A method according to claim 9, wherein the first modular building component is secured directly to the second modular building component.

11. A method according to claim 9, wherein at least one frame member is secured between the first modular building component and the second modular building component.

12. A method according to claim 9, wherein the fabric material is made of a material selected from the group consisting of polypropylene, polyester and nylon.

* * * * *